US007250932B2

(12) United States Patent
Jung

(10) Patent No.: US 7,250,932 B2
(45) Date of Patent: Jul. 31, 2007

(54) DEVICE FOR DRIVING A LIQUID CRYSTAL DISPLAY

(75) Inventor: Woon Hyung Jung, Seoul (KR)

(73) Assignee: Boe Hydis Technology Co., Ltd., Kyoungki-do (KR)

( * ) Notice: Subject to any disclaimer, the term of this patent is extended or adjusted under 35 U.S.C. 154(b) by 453 days.

(21) Appl. No.: 10/670,020

(22) Filed: Sep. 24, 2003

(65) Prior Publication Data

US 2004/0174467 A1 Sep. 9, 2004

(30) Foreign Application Priority Data

Mar. 4, 2003 (KR) ..... 10-2003-0013391

(51) Int. Cl.
*G09G 3/36* (2006.01)

(52) U.S. Cl. ..... 345/100

(58) Field of Classification Search ..... 345/87–102, 345/212–213, 204
See application file for complete search history.

(56) References Cited

U.S. PATENT DOCUMENTS 6,181,317 B1 * 1/2001 Taguchi et al. ..... 345/698
6,185,274 B1 * 2/2001 Kinno et al. ..... 378/98.8
6,909,418 B2 * 6/2005 Arai ..... 345/98
2002/0105490 A1 * 8/2002 Kanbe et al. ..... 345/87
2002/0145586 A1 10/2002 Arai
2004/0174330 A1 * 9/2004 Huang et al. ..... 345/100

OTHER PUBLICATIONS

Chinese Patent Office Action (Mailed Oct. 13, 2006) in Chinese and in its English language translation.

* cited by examiner

*Primary Examiner*—Amr A. Awad
*Assistant Examiner*—Stephen G Sherman
(74) *Attorney, Agent, or Firm*—Ladas & Parry LLP

(57) ABSTRACT

A device for driving an LCD includes a timing control unit, a gate driving unit having a shift register and an output circuit, and a control signal transmission line for transmitting a data carry signal for enabling the shift register and a signal for controlling an data output by the output circuit using a single signal line. The data carry signal uses a rising edge trigger system, and the output control signal uses a level trigger system. In order to prevent an overlapping of the data carry signal and the output control signal, the output control signal is outputted after one clock from a time point where the data carry signal is latched using the shift register.

3 Claims, 4 Drawing Sheets

DEVICE FOR DRIVING A LIQUID CRYSTAL DISPLAY

BACKGROUND OF THE INVENTION

1. Field of the Invention

The present invention relates to a liquid crystal display, and more particularly to a device for driving a liquid crystal display having an improved control signal transmission system between a timing control IC and a driving IC.

2. Description of the Prior Art

As generally known in the art, in order to drive a liquid crystal display (LCD), a drive IC, a timing control ASIC, and an analog circuit should be provided in the corresponding LCD panel. The timing control ASIC serves to receive an RGB signal through a host interface, distribute data to a source driving IC, and a control gate driving IC.

Main control signals generated by the timing control ASIC for the purpose of controlling the source driving IC are a carry signal STH for informing the source driving IC of the start of data, a signal POL for reporting the polarity of an output voltage, a signal LOAD for reporting a latch and output of data, etc. Also, main control signals generated by the timing control ASIC for the purpose of controlling the gate driving IC for driving TFTs are a carry signal STV for informing the gate driving IC of the start of data, a clock signal CPV for driving the IC, and an output control signal OE.

In the control IC of a TFT LCD module, video data and control signals of a pixel driving IC are transmitted in the form of a bus on a printed circuit board (PCB). In this case, it requires a technique having a very high degree of difficulty, designing 36 to 48 image data lines and 10 control signal lines. Especially, due to the development of gates without PCB, wiring to the gate driving IC requires a high degree of difficulty since it should be prepared as a pattern on glass.

The data of the existing LCD driving IC includes basic image data and data for processing various signals, and it is necessary to reduce the data. Especially, as the resolution and data bits increase, the reduction of signals is necessary for an optimum design of the PCB.

SUMMARY OF THE INVENTION

Accordingly, the present invention has been made to solve the above-mentioned problems occurring in the prior art, and an object of the present invention is to provide a device for driving an LCD which can reduce signal lines of a gate driving IC.

In order to accomplish this object, there is provided a device for driving an LCD comprising a timing control unit, a gate driving unit having a shift register and an output circuit, and a control signal transmission line for transmitting a data carry signal for enabling the shift register and a signal for controlling an data output by the output circuit using a single signal line.

The data carry signal uses a rising edge trigger system, and the output control signal uses a level trigger system.

In order to prevent an overlapping of the data carry signal and the output control signal, the output control signal is outputted after one clock from a time point where the data carry signal is latched using the shift register.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
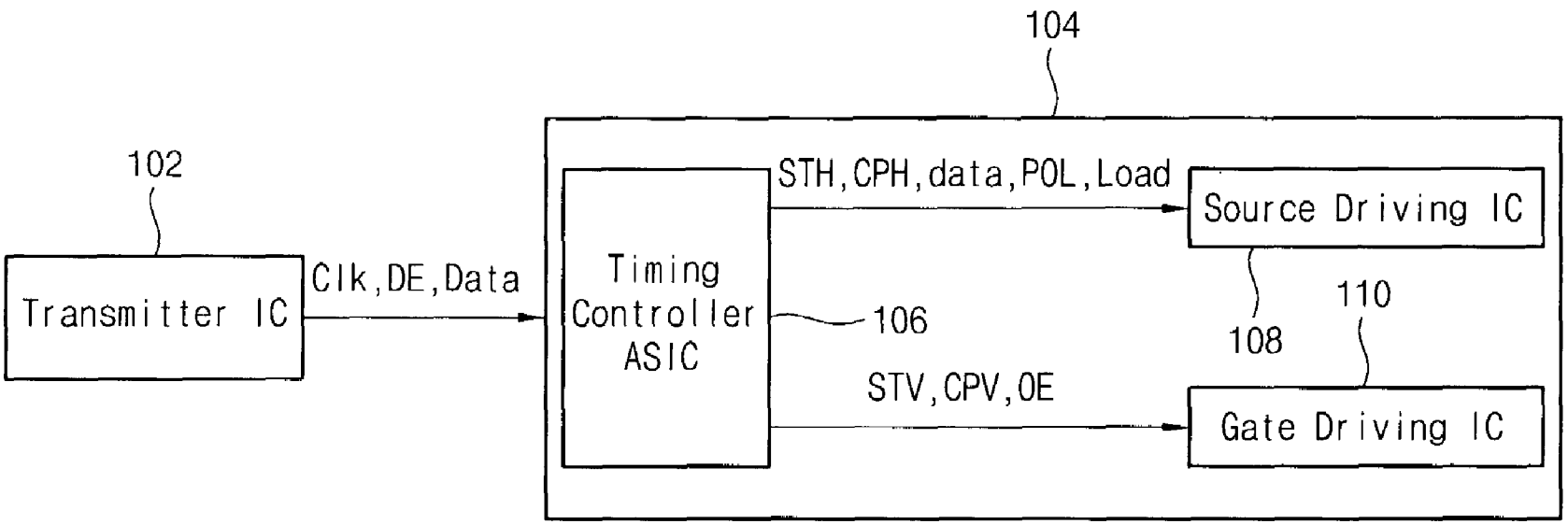
FIG. 1 (Related ART)
FIG. 1 is a view explaining the operation of the conventional LCD driving IC.

Hereinafter, a preferred embodiment of the present invention will be described with reference to the accompanying drawings. In the following description and drawings, the same reference numerals are used to designate the same or similar components, and so repetition of the description on the same or similar components will be omitted.

FIG. 1 is a view explaining the operation of the conventional LCD driving IC. A source driving IC latches RGB data sequentially inputted to match a dot clock, and converts a dot-sequence type timing system into a line-sequence type timing system. The source driving IC transfers data stored in a first latch to a second latch to match a transition enable signal for a period of every horizontal line. The data stored in the second latch is converted into an analog voltage through an analog-to-digital converter, and then applied to data lines through a current buffer. For such a data conversion, the following signals are required as basic control signals. In FIG. 1, the reference numeral '102' denotes a transmitter IC, '104' an LCD module, '106' a timing controller, '108' a source driving IC, and '110' a gate driving IC. Also, 'DE' denotes a data enable signal, 'CLK' a horizontal clock signal, 'STH' a data latch enable signal, 'POL' an output polarity signal, 'LOAD' a data output signal, 'CPV' a vertical clock pulse signal, 'STV' a start vertical pulse signal, and 'OE' a gate output control signal for initializing the gate driving IC for one frame.

Figure 2:
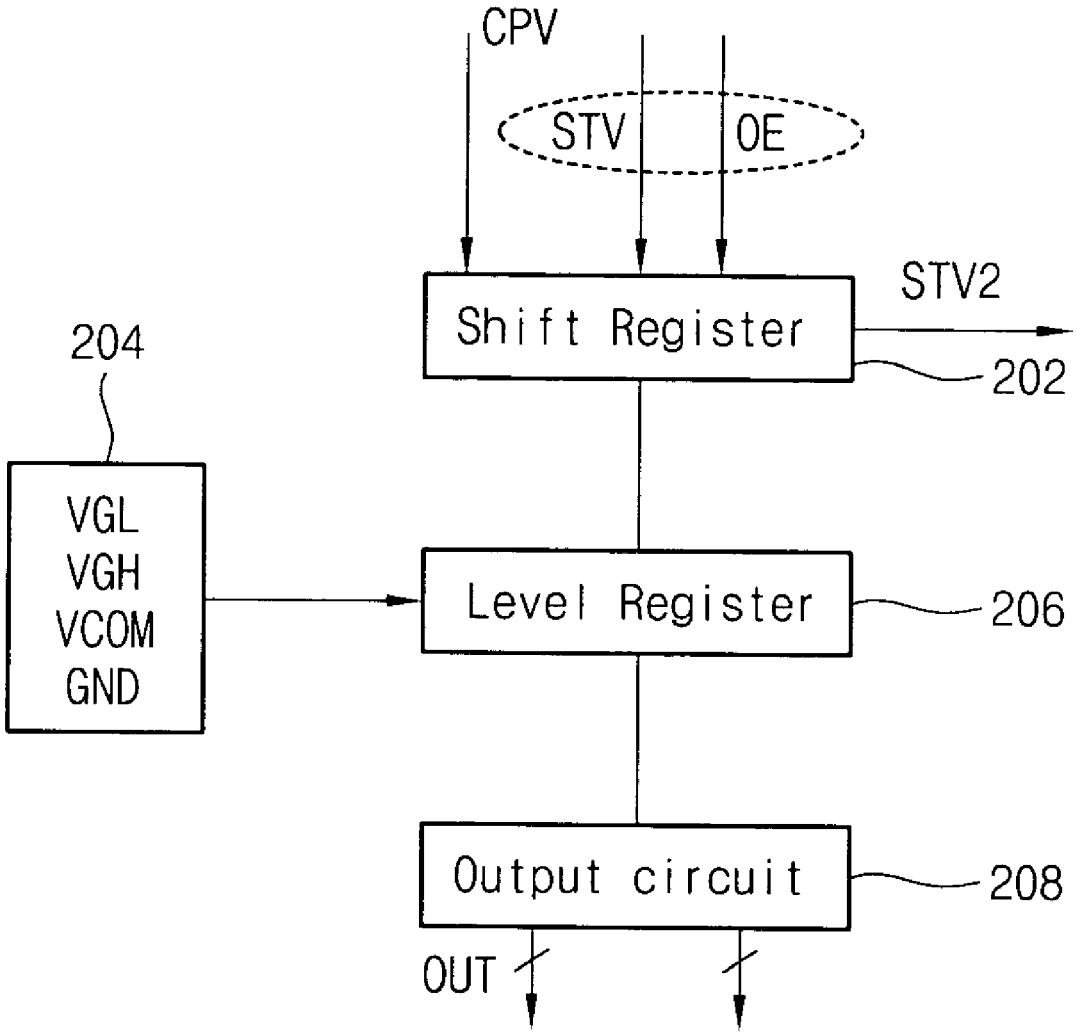
FIG.2 (Related ART)
FIG. 2 is a block diagram illustrating the internal construction of the conventional driving IC.

The internal construction of the driving IC is illustrated in FIG. 2. In FIG. 2, '202' denotes a shift register, '204' a power supply circuit, '206' a level register, and '208' an output circuit. Also 'VGL', 'VHV', 'VCOM' and 'GND' are reference voltage signals having predetermined levels, respectively.

The OE signal currently used plays two roles. First is to intentionally intercept a gate output for one frame in order to stabilizing an initial state, and the second is to periodically intercept an output for a predetermined period in order to periodically change the shape of an output pulse. The present invention proposes an integrated use of an OE signal line for the first role with respect to the STV signal. The OE signal for the second role cannot be used, but the driving thereof causes no problem since it is possible to match the timing by the change of the shape of an analog power supply voltage and by the delay of a load signal.

Figure 3:
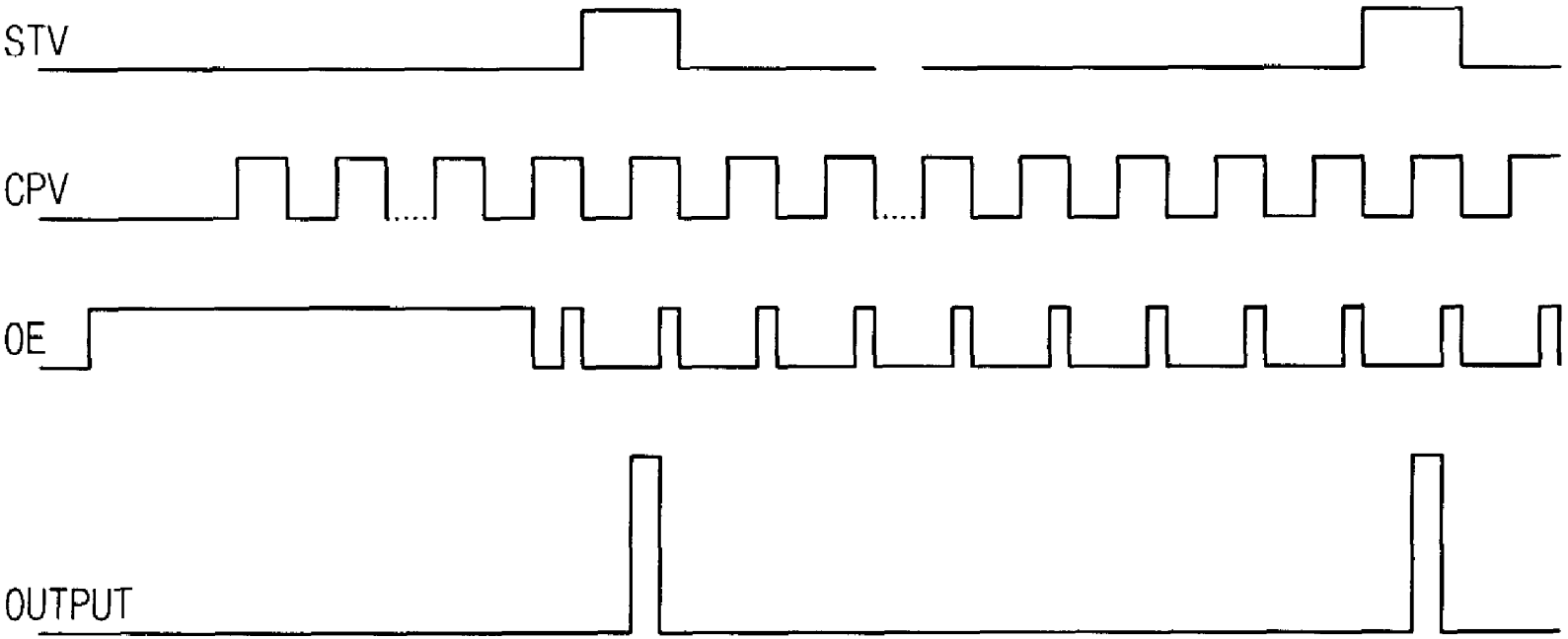
FIG.3 (Related ART)
FIG. 3 is a timing diagram of control signals of the conventional gate driving IC.

FIG. 3 is a timing diagram for driving a general gate driving IC. The gate driving IC pursues an initial stabilization by using the OE signal. The gate driving IC sends its output simultaneously with the latch of the STV at a rising edge of the CPV, and controls the shape of the gate output pulse using the OE signal having a regular timing.

Generally, it is recommended to use the OE signal in the initial state, and by initializing the gate for at least one frame period using the OE signal, an excessive voltage drop of the LCD module can be prevented. If the gate is not initialized when the power is on, the initial value of an internal register of the gate driver is unknown. Thus, if the initial value is "1", all channels of the gates having the value of "1" are open at a time, and this causes an instantaneous overload. In the case of XGA, the load is changed according to how many internal registers in 768 lines have the value of "1", and this affects the VDD voltage, so that the gate driving IC may be reset due to the drop of the VDD voltage.

In addition, a way to solve this problem without using the OE signal is to design the chip so that the initial values of the internal registers become "0". It is also required to intentionally intercept the output through the OE signal line for the initial stabilization, and this initial interception period will be more than a one-frame period in which the 768 internal registers are all "0". However, since the wiring to the gate driving IC should be made in the form of a pattern on a glass according to the development of the gate having no PCB, the reduction of the gate driving control signals is continuously required due to a small installation space.

Figure 4:
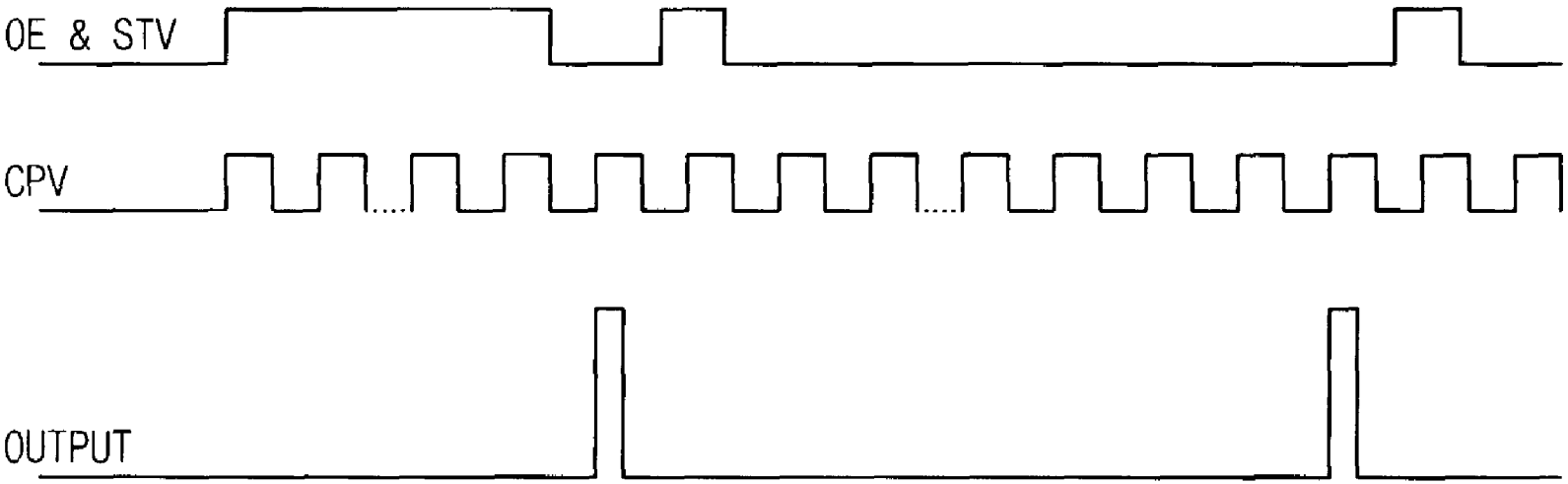
FIG. 4 is a timing diagram of control signals of an LCD driving device according to the present invention.

Since the timing of using the OE signal should be different from the timing of using the STV signal in a general driving state, a transmission system that uses a single signal line should be adopted. Also, since the high-level period of the STV signal corresponds to an area where the output is prohibited, the timing should be adjusted so as not to disturb the actual data output. Referring to a timing diagram of FIG. 4, an initial output prohibition area exists for the common use of the OE signal line, and in a general driving state, a pulse is provided for each frame as an enable signal. In order not to disturb the data output, the OE signal is outputted after one clock from the time point where the STV signal is latched using the shift register.

As described above, according to the present invention, the number of control signals required for driving the TFT LCD is reduced, and this causes the PCB design to be simplified and the signal interference phenomenon reduced. Also, the present invention provides simple wiring on the glass, simplifies the circuit block of the timing controller, and reduces the installation area.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A device for driving an LCD comprising:

a timing control unit;

a gate driving unit operatively connected to said timing control unit and operatively connectable to a power supply circuit, the gate driving unit having a shift register, a level register and an output circuit, wherein the shift register, level register and the output circuit operatively interconnected together; and a control signal transmission line operatively connected to the gate driving unit, the control signal transmission line for transmitting a data carry signal in which the data carry signal is used as an enable signal for each frame wherein the data carry signal is latched using the shift register, and the control signal transmission line for outputting an output control signal in which the output control signal is outputted after the data carry signal is latched, wherein a number of control signals required for driving the LCD is reduced whereby PCB design is simplified and signal interference phenomenon is reduced.

2. The device as claimed in claim 1, wherein the data carry signal uses a rising edge trigger system.

3. The device as claimed in claim 1, wherein in order to prevent an overlapping of the data carry signal and the output control signal, the output control signal is outputted after one clock from a time point where the data carry signal is latched using the shift register.

* * * * *